United States Patent [19]

Seragnoli

[11] Patent Number: 4,541,221

[45] Date of Patent: Sep. 17, 1985

[54] METHOD OF AUTOMATICALLY CHANGING REELS OF STRIP MATERIAL IN PACKAGING MACHINES

[75] Inventor: Enzo Seragnoli, Bologna, Italy

[73] Assignee: G.D. Societa Per Azioni, Bologna, Italy

[21] Appl. No.: 415,827

[22] Filed: Sep. 7, 1982

[30] Foreign Application Priority Data

Oct. 9, 1981 [IT] Italy ..... 3546 A/81

[51] Int. Cl.[4] ..... B65B 57/00

[52] U.S. Cl. ..... 53/396; 53/54; 53/55; 53/57; 53/65; 53/73; 53/389; 242/58.1

[58] Field of Search ..... 53/53, 54, 57, 65, 73, 53/389, 494, 506, 55, 396; 156/504, 505; 242/58.1, 58.5

[56] References Cited

U.S. PATENT DOCUMENTS 3,318,066 5/1967 Seragnoli ..... 53/53
3,374,963 3/1968 Conti ..... 156/504 X
3,628,309 12/1971 Seragnoli ..... 53/54 X
3,967,994 7/1976 Langberg ..... 242/58.5 X
3,995,791 12/1976 Schoppee ..... 156/505 X
4,135,344 1/1979 Seragnoli ..... 53/54

*Primary Examiner*—John Sipos
*Assistant Examiner*—Steven P. Weihrouch
*Attorney, Agent, or Firm*—Michael J. Striker

[57] ABSTRACT

Method of automatically changing reels (17,20) of strip material (15–21) in packaging machines, especially packaging machines (1) for cigarettes, equipped, along a feed line (2), with an ejection device (9) adapted for ejecting from said line (2) those objects (5) to be packaged that are defective and for determining a corresponding arresting of said strip material (15–21), the method providing for the utilization of said ejection device (9), in response to an end of reel signal emitted by a sensor (26,27), for determining the arresting of the associated strip material (15,21) so as to permit the changing of the reels (17,20) with strip (15,21) stopped and the subsequent recommencing of the feed of the strip (15,21) in perfect synchronism with the packaging line (2).

4 Claims, 1 Drawing Figure

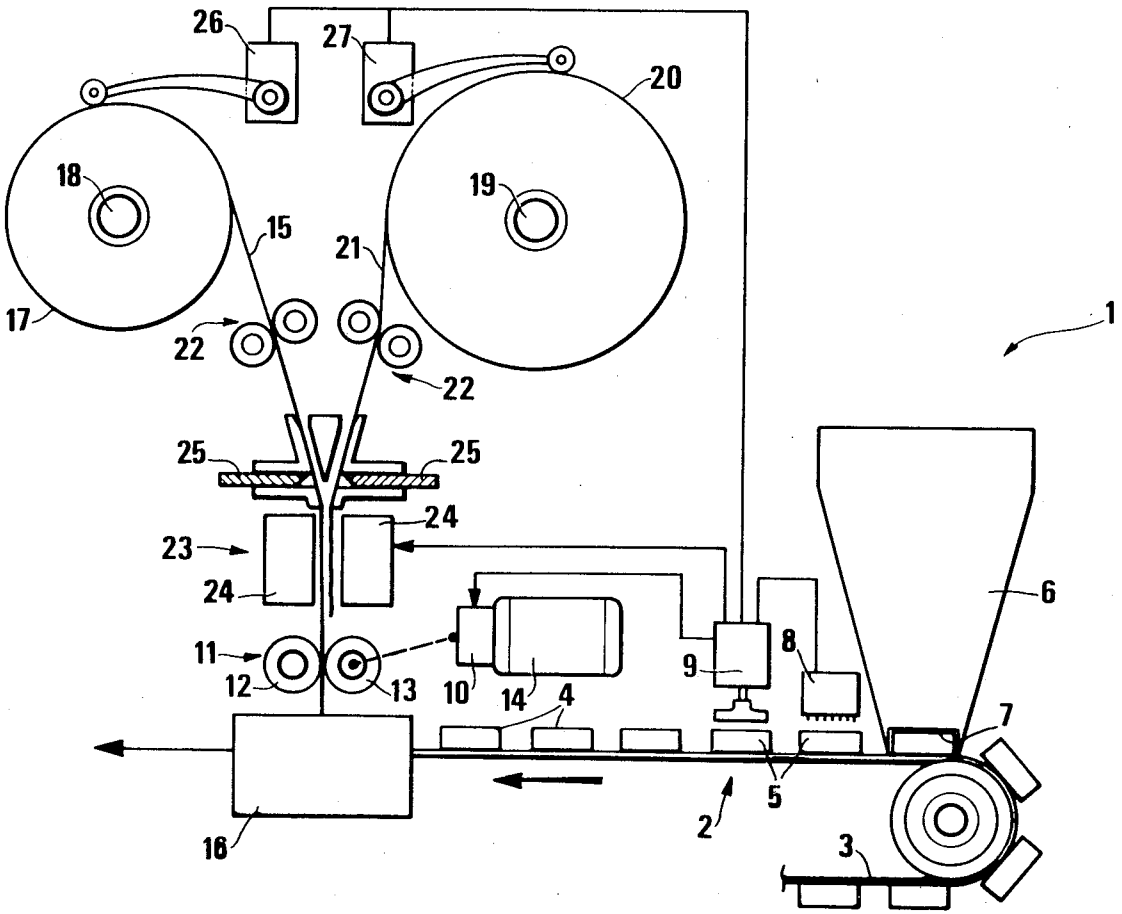
1
6
7
3
8
5
2
9
20
4
14
19
10
22
25
24
13
27
21
15
26
22
25
23
24
11
12
16
18
17

METHOD OF AUTOMATICALLY CHANGING REELS OF STRIP MATERIAL IN PACKAGING MACHINES

BACKGROUND OF THE INVENTION

This invention relates to a method of automatically changing reels of strip material in packaging machines.

In particular, the present invention relates to a method especially adapted to be used on cigarette packaging machines, but advantageously capable of being used on any machine adapted for packaging or wrapping objects of relatively small dimensions, to permit the automatic changing of reels of wrapping material in strip form when said reels are exhausted.

The description which follows refers, without thereby in any way losing its generality, to packaging machines for cigarettes, for the reason that, as stated, the present invention finds its most advantageous application on this type of machine.

In general, modern packaging machines can be reduced schematically to a feed or conveying line, normally comprising one or more linear conveyors and a plurality of drum conveyors, along which the cigarettes issuing from a feed hopper and subdivided into groups are caused to advance in a continuous or step motion inside respective conveying chests.

Each group of cigarettes is subjected, in correspondence with precise points of the aforementioned line, to a series of wrapping operations, one or more of which are carried out by using strip wrapping material supplied from a reel.

With the objective of reducing dead working times to a minimum each feed reel is normally associated with a corresponding reserve reel, which should be capable of being substituted for the reel in use when the latter is close to being exhausted.

In general, the methods followed for the automatic replacement of a reel on cigarette packaging machines are two in number, and are distinguished from each other by the fact that the replacement of the reels is effected in one with the strip in motion, while in the other it is with the strip stopped. Leaving out the methods of automatic replacement with the strip in motion and examining solely the automatic methods with the strip stopped, it is possible to state that the latter generally provide for the use of a sensor adapted for emitting a signal when the reel in use is close to being exhausted. This signal generally determines the decoupling, for a determined period, of a transmission group interposed between an actuating motor and a group for entraining the strip becoming exhausted. This strip consequently undergoes a brief arresting sufficient for permitting it to be connected to one end of a strip of a new reel, and permitting it to be cut upstream of the junction zone in the direction of feed of the strip itself, with resultant unreeling of the new reel when the aforementioned transmission group is recoupled. The method of operation described above normally involves difficulties, for the reason that the recommencing of the feed of the strip of wrapping material should take place absolutely in phase with the feed of the said objects to be wrapped along said conveying line. Consequently, it is normally required that not only said transmission group shall be controlled by said end of reel sensor, but also that the transmission groups which control the feed of the conveying line shall be so controlled, with the undesired result of rendering the controlling system for same extremely complicated and expensive.

SUMMARY OF THE INVENTION

The object of the present invention is that of permitting the automatic replacement of a reel in process of becoming exhausted with a new reel, the strip being stopped, guaranteeing, at the recommencement of the movement of the strip, a perfect phasing between the latter and the conveying line for the objects to be wrapped and without comprising, for that purpose, substantially any complication of the control system for the aforementioned line.

The aforementioned object is achieved by the present invention in so far as it relates to a method for the automatic changing of reels of strip material in packaging machines, especially cigarette packaging machines, equipped, along a feed line for the objects to be packaged, with sensor means adapted for detecting possible defects in the objects to be packaged, with an ejection device adapted for ejecting any defective objects, and with entraining means for said strip material comprising a transmission group capable of being decoupled, and controlled by said ejection device, end of reel sensing means being provided for detecting the approaching exhaustion of each said reel in use, and jointing means being disposed between each said reel in use and said feed line for connecting the relevant said strip to the end of a strip of a corresponding reserve reel, characterized by determining an arresting of said strip in course of exhaustion, for permitting the jointing of same to the strip of said reserve reel by said jointing means with strips stopped, by means of the connection of said end of reel sensing means to an input of said ejection device in such a manner as to determine the ejecting of one said object and a corresponding decoupling of said transmission group following upon the emission of an end of reel signal.

Other characteristics and advantages of the present invention will become apparent from the description given below with reference to the attached drawing.

BRIEF DESCRIPTION OF THE DRAWING

The drawing illustrates in schematic and block form, a packing apparatus utilizing a method of changing reels of strip material pursuant to the present invention.

DETAILED DESCRIPTION OF THE PREFERRED EMBODIMENTS

In the attached FIGURE, reference 1 denotes a packaging machine equipped with a feed line 2, which, in the example illustrated, comprises a belt conveyor 3, itself known, possessing a plurality of conveying chests 4 each containing one object, in particular a group of cigarettes 5, to be packaged. The chests 4, advancing along the line 2, pass beneath a feed hopper 6, itself known, into which the cigarettes to be packaged are fed from above. These cigarettes emerge from the lower end 7 of the hopper 6 subdivided into the aforementioned groups 5, which occupy the chests 4 passing successively beneath the end 7.

The groups 5 of cigarettes leaving the hopper 6 are caused to advance beneath a sensor device 8, itself of known type, capable of detecting any imperfections present in the groups 5 themselves and of controlling an ejection device 9, itself known and normally present on packaging machines in use, the task of which is to eject from the associated chests 4 any defective groups 5.

The ejection device 9 possesses an output, through which can be emitted, in known manner, control signals for a transmission group or coupling 10, normally constituted, on known packaging machines, of a friction group with electromagnetic coupling. The latter is interposed between an entrainment group 11 comprising opposed rollers 12 and 13 and an associated actuating motor 14 for preventing, in a manner which is itself known, the feeding of a strip 15 of wrapping material to a wrapping group 16 when said group is being traversed by a chest 4 previously emptied by the ejection device 9.

The strip 15 unreels from a feed reel 17 rotatably mounted on a support axle 18, disposed alongside a support axle 19 for a second feed reel 20 for a reserve strip 21. The strips 15 and 21 unreel through respective guide groups 22 comprising rollers disposed upstream of a jointing group 23. The latter comprises two blocks 24, movable between an at-rest, open position and an operative, closed position, in which latter position they are adapted for squeezing between them the strip 15 and an end portion of the strip 21 to join them integrally one to the other in a manner which is of itself known, for example by the interposition of an adhesive.

The group 23 comprises in addition, above each block 24, a respective knife 25, itself known, adapted for selectively cutting the associated strip 15, 21 when the jointing has been carried out.

The external periphery of each of the reels 17 and 20 cooperates with a respective proximity sensor 26, 27 which, when the associated reel is close to exhaustion, emits a signal which is fed to an input of the ejection device 9, a further output of which is adapted for emitting a control signal for the jointing device 23.

In use, the replacement of the reel 17 in course of exhaustion by the new reel 20 is carried out automatically by the machine 1 following upon the emission of an end of reel signal by the sensor 26.

This signal, passing to the input of the ejection device 9, determines the actuation thereof independently of the detections carried out by the sensor device 8. Consequently, the sensor device 9 determines the ejection of at least one group 5 from the associated chest 4 which is situated at that instant opposite thereto, and memorizes the effected ejection in such a way as to emit, with a predetermined delay, a signal adapted for determining the decoupling of the coupling 10 when the aforementioned empty chest 4 reaches the wrapping group 16. Contemporaneously with the decoupling signal, the ejection device 9 emits an actuating signal for the jointing group 23 which, during the stopping of the strip 15 due to the decoupling of the entraining group 11, carries out, in known manner, the jointing between the strip 15 in course of exhaustion and the head of the reverse strip 21, previously placed by an operative between the movable blocks 24.

The jointing having been carried out, the portion of strip 15 disposed upstream of the jointing group 23 is separated from the rest by means of the associated knife 25.

Subsequently, the line 2 determines, in a manner itself known, the recoupling of the coupling 10, that is to say the recommencement of the feed of the tail of the strip 15 and of the head of the strip 21, perfectly in phase with the feed of the line 2 under the control of known devices, not illustrated, normally present on packaging machines for controlling the recommencement of the feed of the wrapping materials following upon stops due to the ejection of one or more groups 5.

In relation to the foregoing description, it is appropriate to draw attention to the fact that, apart from the actuating of the jointing group 23, the ejection device 9, itself known and largely used on all modern cigarette packaging machines available on the market, does not carry out any other function different from those normally carried out, and that one of the principal advantages offered by the present invention consists in this very utilization of a device already present for determining the stopping of the strip 15 necessary for its replacement and the recommencing of the feed of the tail of the strip 15 and of the head of the strip 21 in perfect phase with the recommencement of the feed of the line 2.

Evidently, in the case in which, along the line 2, the wrapping groups fed from reels are more than one number, the ejection device 9 can be connected to all the end of reel sensors determining, upon reception of a signal emitted by one of them, the progressive decoupling of all of the couplings 10 step by step as the empty chest 4 passes through the relevant wrapping groups, and the actuation of only that one of the jointing groups 23 which corresponds to the end of reel sensor which has emitted the signal.

I claim:

1. A method of automatically changing reels of strip wrapping material in a packaging machine of the type in which wrapping of successive objects is accomplished by conveying the objects to a wrapping station along a conveyor line, and automatically disabling a drive to a feed device for the wrapping material by way of a disabling means for a predetermined period after detecting and removing a defective object from the conveyor line, the period being synchronized with the conveying of the objects into the wrapping station, the method comprising the steps of: sensing an approaching end of the strip material carried on a first reel and sending a corresponding output signal; actuating the disabling means in response to said output signal; and further comprising the step of feeding said output signal from said sensing and sending step to a device for controlling the removing of defective objects from the conveyor line and in response thereto ejecting at least one object from said conveyor line; sending a first resulting output from said controlling device to said disabling means; performing said actuating step in response to said first resulting output; and joining a leading end portion of strip material from a second reel to a tail end portion of the strip material from the first reel in response to said output signal while the drive to the feed device is disabled and while said conveyor line is continually moving.

2. A method as defined in claim 1, wherein said feeding step includes sending a second resulting output from said controlling device, said joining step including joining in response to said second resulting output.

3. A method as defined in claim 2, wherein said first and second resulting outputs occur substantially simultaneously after a predetermined delay.

4. A wrapping machine in which successive objects to be wrapped by a strip wrapper material held on supply reels are conveyed to a wrapping station along a conveyor line, the machine comprising: a first sensor for sensing defective objects on the conveyor line and for putting out a corresponding output; means for removing a defective object from the line in response to said output from said first sensor; a second sensor for sensing an approaching end of the strip wrapper material carried on a first supply reel; means for advancing the strip material from the first reel to the wrapping station, said advancing means including a drive transmission for disengagement of said advancing means in response to operation of said object removing means, and said removing means having means responsive to an output from said second sensor whereby said drive transmission of said advancing means is also disengaged by operation of the object removal means in response to said output from said second sensor; and means for joining a leading end of strip material from a second reel to a tail end of strip material from the first reel in response to said output signal while said drive transmission of said advancing means is disabled and while said conveyor line is continuously moving.

* * * * *